United States Patent [19]

Sollie et al.

[11] Patent Number: 4,518,051

[45] Date of Patent: May 21, 1985

[54] PERCUSSION ACTUATED CORE SAMPLER

[75] Inventors: Steinar Sollie; Arilo A. Andresen, both of Oslo, Norway

[73] Assignee: Chevron Research Company, San Francisco, Calif.

[21] Appl. No.: 509,892

[22] Filed: Jun. 30, 1983

[51] Int. Cl.[3] ..... E21B 25/00; E21B 49/02

[52] U.S. Cl. ..... 175/250; 175/58; 175/246; 175/296; 73/864.45

[58] Field of Search ..... 73/864.45, 864.44; 175/58, 403, 404, 244, 246, 247, 248, 249, 250, 253, 254, 296, 239, 240, 236, 332, 333, 309, 330, 20

[56] References Cited

U.S. PATENT DOCUMENTS

| | | | |
|---|---|---|---|
| 2,005,989 | 6/1935 | Burt | 175/296 X |
| 2,109,197 | 2/1938 | Humason | 175/240 X |
| 2,170,716 | 8/1939 | Higgins, Jr. | 175/58 |
| 2,345,739 | 4/1944 | Fisher | 175/296 X |
| 2,557,925 | 6/1951 | Stokes | 175/236 X |
| 2,623,733 | 12/1952 | Sewell | 175/248 |
| 2,758,817 | 8/1956 | Bassinger | 175/296 X |
| 2,837,315 | 6/1958 | Burns, Jr. et al. | 175/296 |
| 3,552,500 | 1/1971 | Peterson | 175/296 X |
| 3,807,512 | 4/1974 | Pogonowski et al. | 175/296 X |
| 4,002,213 | 1/1977 | Sweeney | 175/248 X |

FOREIGN PATENT DOCUMENTS

| | | | |
|---|---|---|---|
| 1437420 | 5/1976 | United Kingdom | 175/248 |
| 554397 | 8/1974 | U.S.S.R. | 175/249 |

OTHER PUBLICATIONS

Fugro Ltd. Letter, May 14, 1982, with one page attachment.

Ocean Industry article dated Dec. 1982, one page.

General Description of Hydraulic Breaker, one page.

*Primary Examiner*—Jerry W. Myracle

*Assistant Examiner*—Tom Noland

*Attorney, Agent, or Firm*—Edward J. Keeling; S. R. LaPaglia

[57] ABSTRACT

The present invention provides a percussion actuated wire line sampler for use in a drill string. The sampler includes a core barrel adapted to be inserted into the drill string and to be freely movable therein. A hydraulic percussion device (16) also insertable and freely movable in the drill string is connected to the core barrel. A downhole mud turbine (20) is provided and is responsive to drilling mud pressure to actuate the percussion device to drive the core barrel out of the end of the drill string into the material to be sampled.

11 Claims, 5 Drawing Figures

PERCUSSION ACTUATED CORE SAMPLER

CROSS REFERENCE TO RELATED APPLICATIONS

This application is related to applications Ser. Nos. 509,889 and 509,891, filed June 30, 1983, by the inventors of this invention and assigned to a common assignee.

BACKGROUND OF THE INVENTION

It is important to have good core samples particularly in offshore work. This is especially true in offshore site investigation which is a prerequisite to foundation analysis for offshore structures, and the like.

Heretofore, piston samplers have been used to obtain offshore core samples. These samplers have required a substantial amount of extraneous equipment such as compensators and bumper subs on the drill string as well as heavy jacks for gripping the sea floor during sampling. There is need therefore for improved samplers having simplicity and durability.

BRIEF DESCRIPTION OF PREFERRED EMBODIMENT

Broadly, the present invention provides a wire line core sampler for use in a drill string sub. A core barrel is adapted to be inserted into the sub and freely movable therein. Hydraulic percussion means, insertable into the sub and freely movable therein, are operably connected to the core barrel. Mud turbine means, insertable into the sub and freely movable therein, are connected to the hydraulic percussion means for circulating hydraulic fluid to operate the percussion means to drive the core barrel out of the drill string sub and into the material to be sampled.

More specifically, the present invention provides a percussion-driven wire line core sampler for use in a drill string. A tubular cylindrical sub is provided for connection to the lower end of the drill string. A core barrel is inserted into the sub and is freely movable therein. The core barrel is adapted to take soil samples. A core barrel adaptor closes off the upper end of the core barrel. The core barrel adaptor includes an anvil block extending above the core barrel. Hydraulic percussion means are inserted into the sub and are freely movable therein. The hydraulic percussion means are operably connected to the core barrel adaptor. The hydraulic percussion means includes a hammer for striking the anvil block. A mud turbine also insertable into the sub and freely movable therein is connected to the hydraulic percussion means. Mud seal means are utilized to close off the annular space between the interior of the sub and the outside of the sampler so that the mud turbine may operate efficiently. The mud turbine drives a hydraulic pump in the percussion means to circulate hydraulic fluid to operate the percussion means. Thus in operation, the hammer of the percussion means repeatedly strikes the anvil block of the core barrel adaptor to drive the core barrel into the material to be sampled.

OBJECTS OF THE INVENTION

It is a principal object of the present invention to provide a percussion actuated wire line sampler for use in a drill string, which sampler includes downhole means responsive to drilling mud pressure for driving a core barrel into the material to be sampled. Additional objects and advantages of the present invention will become apparent from reading the following detailed description in view of the accompanying drawings which are made a part of this specification.

DETAILED DESCRIPTION OF THE PREFERRED EMBODIMENT

Figure 1:
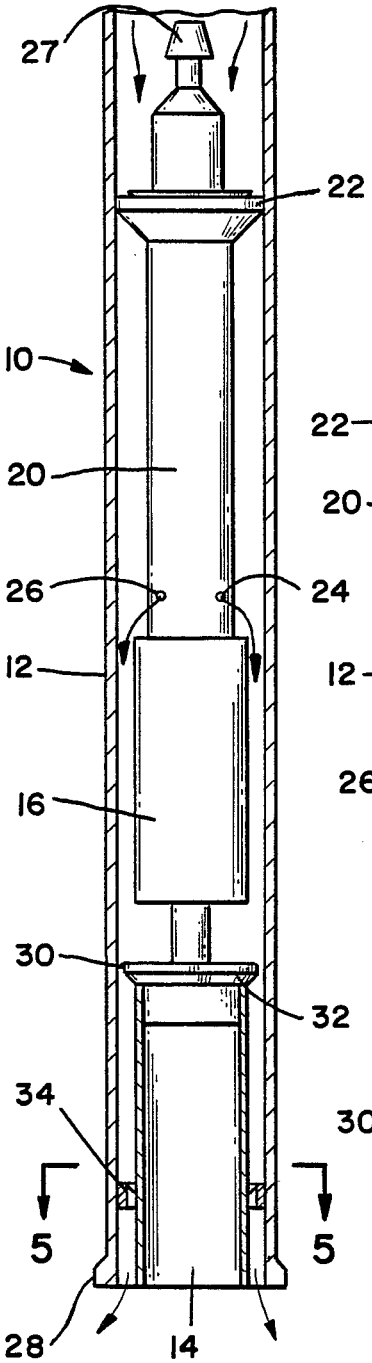
FIG. 1 is an elevation view with portions cut away for clarity of presentation and illustrates the preferred embodiment of apparatus assembled in accordance with the invention positioned at a sampling location.

FIG. 1 illustrates the preferred embodiment of apparatus of the present invention inserted into a tubular drill string sub adjacent the material to be sampled. The wire line core sampler is indicated generally by the numeral 10. The drill string sub 12 is connected to the lower end of a drill string (not shown). A core barrel 14, insertable into the sub and freely movable therein, is located in the sub in position to take a sample. Hydraulic percussion means 16, insertable into the sub and freely movable therein, are operably connected to the core barrel 14. Mud turbine 20, insertable into the sub and freely movable therein, is connected to the closed hydraulic system of the hydraulic percussion means 16 for circulating hydraulic fluid to operate the percussion means 16 to drive the core barrel out of the drill string sub 12 into the material to be sampled. Mud seal means 22 for closing off the annular space between the interior of the sub and the exterior of the sampler are connected to the sampler to direct mud flow into the intake of the mud turbine 20. Preferably, the mud seal means is a dynamic mud seal which is slidable inside the drill string.

Exhaust ports 24, 26 are provided for exhausting drilling mud after it has been used to drive the mud turbine into the annular space between the outside of the sampler 10 and the interior of the drill string sub 12. This mud is then flowed out of the bottom of the drill string sub 12. The drill string sub may be provided with a drill bit 28 for use in drilling into the material which is to be sampled. A wire line recovery nipple 27 is located at the top of the core sampler.

Figure 2:
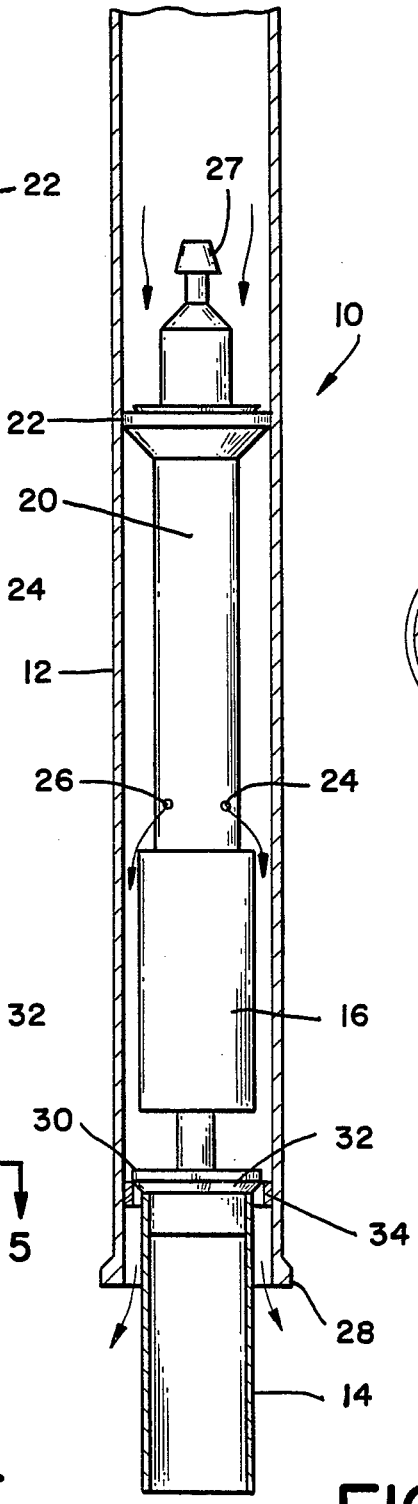
FIG. 2 is an elevation view with portions cut away for clarity of presentation and illustrates the preferred embodiment of apparatus with the core barrel extended into the material to be sampled.
Figure 5:
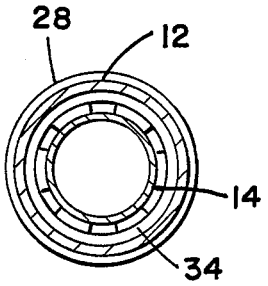
FIG. 5 is a sectional view taken at line 5—5 of FIG. 1.

A travel retainer collar 30 is located at the upper end of the core barrel adaptor 32. The travel retainer collar interacts with the serrated ring 34 to limit downward travel of the core barrel 14. Thus, as shown in FIG. 2, the travel retainer collar 30 engages the serrated ring 34 when the core barrel 14 has been fully driven into the sample. The notches in the serrated ring allow drilling mud to pass out of the end of the tubular sub.

Figure 3:
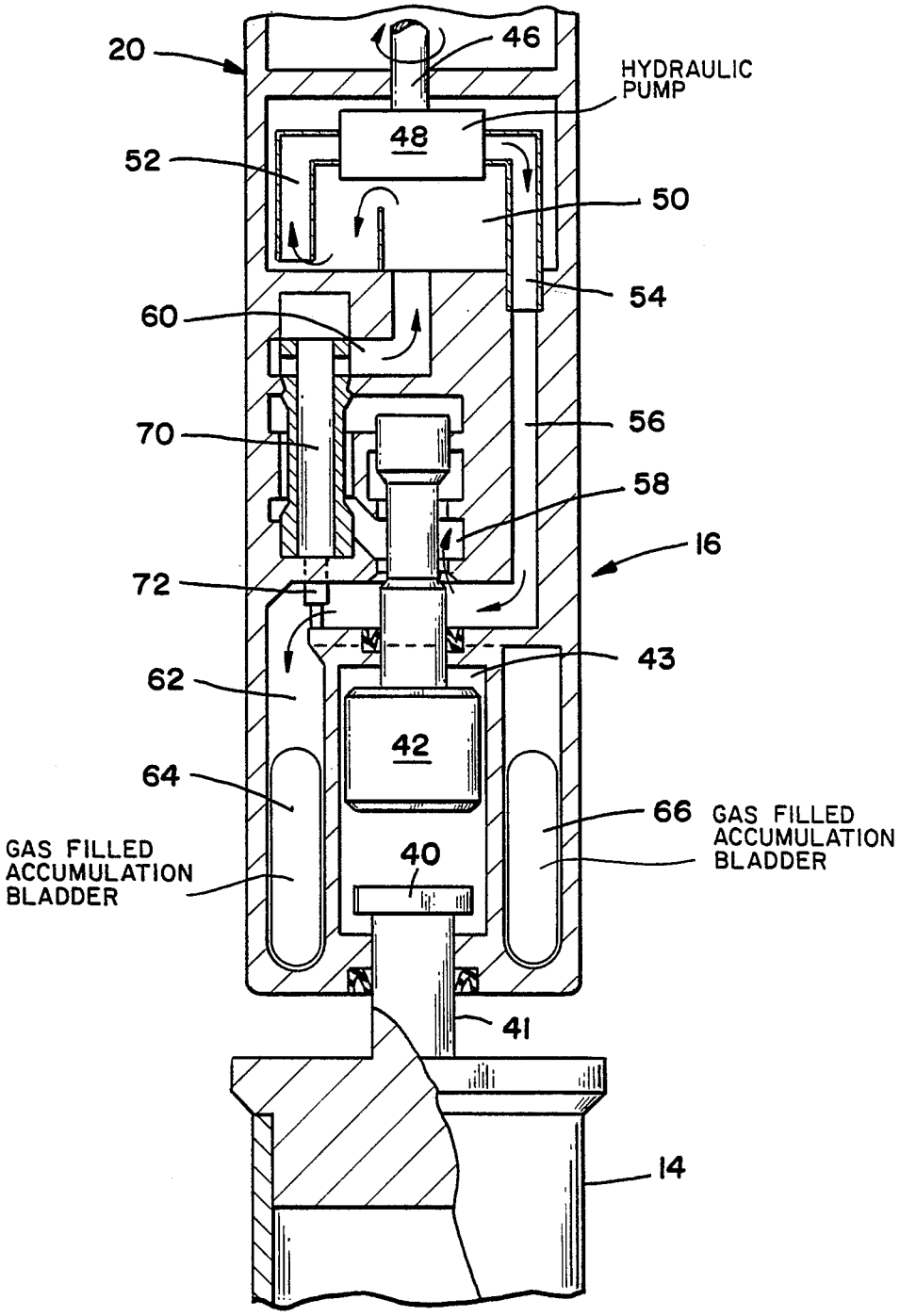
FIG. 3 is an enlarged elevation view partially in section and illustrates a portion of the apparatus of FIGS. 1 and 2 in more detail.

A suitable downhole means responsive to drilling mud pressure to drive the core barrel into the material to be sampled is illustrated in FIG. 3. FIG. 3 is an enlarged elevation view partially in section and illustrates a portion of the apparatus of FIGS. 1 and 2 in more detail. Elements common to FIGS. 1, 2 and 3 are given the same numbers in all figures.

FIG. 3 illustrates a wire line core sampler for use in a drill string sub including a core barrel 14 which is insertable into the sub and freely movable therein. A core barrel adaptor 30 closes off the upper end of the core barrel 14. The core barrel adaptor 30 includes an anvil block 40 extended above the core barrel 14 by means of shaft 41.

A hydraulic percussion means, generally indicated as 16, which is insertable into the sub and freely movable therein is operably connected to the core barrel adaptor by means of shaft 41 and anvil block 40. In preferred form, hydraulic percussion means utilize a hydraulic pump and an oil reservoir in a closed hydraulic circuit completely contained within the body of the sampler. Hydraulic percussion units cannot be practically operated directly under the high down-the-hole back pressure caused by a large head of water such as, for example, 400 meters. The hydraulic percussion means includes a hammer 42 for striking the anvil block. A mud turbine generally indicated by the numeral 20, which is insertable into the sub and freely movable therein, is connected to the hydraulic percussion means. The mud turbine's rotor shaft 46 is connected to a hydraulic pump 48. The shaft actuates the hydraulic pump when the turbine is rotated by drilling mud and thus provides means for circulating hydraulic fluid to operate the percussion means. Mud turbines suitable for use in the invention are commercially available and are known in the art.

The hydraulic percussion means 16 illustrated in FIG. 3 is an adaptation of a hydraulic pavement breaker of Macdonald Hydratools Ltd. of Scotland. The original tool was used as a hand tool to break concrete. The adaptations were necessary modifications to fit the percussion means inside a 4" drill pipe. The hydraulic percussion means operates by automaically porting the working fluid such that it continuously reciprocates the hammer 42 within the percussion means. A blow is delivered to the anvil block 40 on each downstroke. When the drilling fluid is pressurized and the mud turbine acts to operate the hydraulic pump, oil entering the percussion means lifts the hammer 42 up in its cavity 43 while exhausting oil into the discharge line. At the top of the hammer stroke, internal porting redirects the oil onto the top of the hammer imparting a velocity to the hammer mass. At the bottom of the stroke, the kinetic energy of the hammer is transferred to the anvil, thereby doing work. Because the return oil is exhausted by the upstroke of the hammer, the inlet pressure is proportional to the back pressure at the exhaust port. As the flow rate is increased, the back pressure increases. Therefore, the pressure at the inlet also increases.

Thus, oil from the oil reservoir 50 enters the suction pipe 52 of the hydraulic pump 48 which is driven by rotating shaft 46. High pressure oil enters through the oil pressure inlet 54 into the circulation system conduits 56, 58, 60 and 62 of the percussion means. Gas filled accumulation bladders 64, 66 act to boost the pressure of the liquid. Suitable valving provides for continuous cycling of the percussion means in response to the flow of high pressure oil which in turn is supplied by the rotation of the mud turbine in response to drilling mud pressure.

Figure 4:
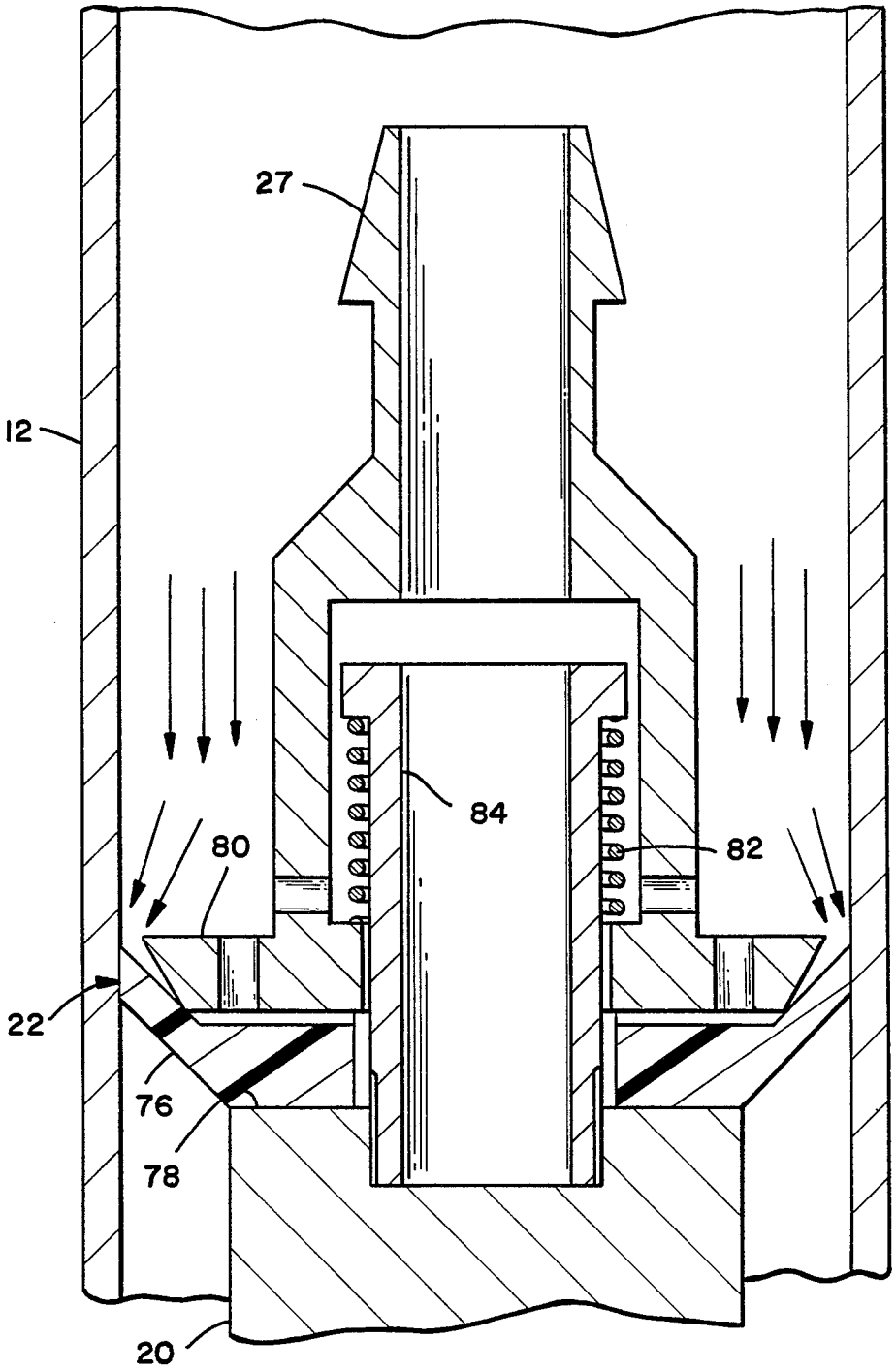
FIG. 4 is an enlarged view of the preferred mud seal means of the present invention.

The preferred mud seal means 22 is illustrated in greater detail in FIG. 4. As there shown, sealing element 76, made of elastic material such as rubber, engages against the inside of the drilling sub 12. The sealing element 76 is connected between shoulder 78 of the mud turbine and the flanged portion of the wire line recovery nipple 27. A helical spring 82 is positioned between the recovery nipple and the upper portion 84 of the mud turbine. The sealing element is sized to slip inside the drill string so that the sampler will slide down the drill pipe under the force of gravity. Once the sampler contacts the material to be sampled and stops the combined action of the resilient sealing element 76 and the force exerted by the helical spring 82 causes the sealing element to engage the drilling sub 12 with sufficient pressure to prevent drilling mud bypass. This initial contact pressure will be increased as the drilling mud pressure is increased. The function of the mud sealing means may also be facilitated by selecting the drilling sub with a slightly smaller internal diameter than the internal diameter of the drill pipe to insure suitable contact between the sealing element and the interior wall of the sub.

The sampler of the present invention is wire line operated. The sampler is dropped into the drill string that is full of liquid (drilling mud) and it travels down to the sampling position by its own weight. The sampler is activated by introducing drilling mud under pressure from the drilling system on the drill vessel. The sampling operation is monitored by flow and pressure controls of the drilling system. FIG. 1 shows the sampler located in the sub in position to begin a sampling operation. Pressure on the liquid in the drilling system is increased to increase the pressure on the mud seal means and to drive the mud turbine. The mud turbine drives the hydraulic percussion means which in turn drives the core barrel 13 down into the material to be sampled. FIG. 2 illustrates the position of the core barrel fully extended into the material. Note that only the core barrel has been extended out of the sub. After sampling, the sampler is retrieved from the drill string by standard wire line overshot procedure.

Thus, the present invention provides a wire line core sampler for use in a drill string sub including a core barrel insertable into the sub and freely movable therein. Hydraulic percussion means are also insertable into the sub and freely movable therein and are operably connected to the core barrel. Mud turbine means which are insertable into the sub and freely movable therein are connected to the hydraulic percussion means for circulating hydraulic fluid to operate the percussion means to drive the core barrel out of the drill string into the material to be sampled. Mud seal means for closing off the annular space between the interior of the sub and the exterior of the sampler are provided to insure efficient operation of the mud turbine.

While certain specific embodiments of the invention have been described in detail, the invention is not to be limited to only these embodiments but rather by the scope of the appended claims.

What is claimed is:

1. A wire line core sampler for use in a drill string sub comprising a drill string sub connectable to the lower end of a drill string, a core barrel insertable through said drill string into said sub and freely movable therein; hydraulic percussion means insertable through said drill string into said sub and freely movable therein operably connected to said core barrel; and downhole means responsive to drilling mud pressure for actuating said hydraulic percussion means to drive said core barrel out of the end of the drilling string sub into the material to be sampled.

2. A wire line core sampler for use in a drill string sub said sub and said sampler defining an annular space therebetween comprising a drill string sub connectable to the lower end of a drill string; a core barrel insertable through said drill string into said sub and freely movable therein; hydraulic percussion means insertable into said sub and freely movable therein operably connected to said core barrel; and mud turbine means insertable into said sub and freely movable therein connected to said hydraulic percussion means for circulating hydraulic fluid to operate said hydraulic percussion means to drive said core barrel out of the end of said drill string sub into the material to be sampled.

3. The apparatus of claim 2 further comprising mud seal means for closing off the annular space between the interior of said sub and the exterior of said sampler.

4. The core sampler of claim 3 further characterized in that said mud seal means is a dynamic mud seal slidable inside the drill string and comprises at least one resilient sealing element and spring means urging said sealing element in contact with the interior of said sub.

5. A wire line core sampler for use in a drill string comprising a tubular drill string sub; a core barrel insertable into said sub and freely movable therein; hydraulic percussion means insertable into said core barrel; mud turbine means insertable into said sub and freely movable therein connected to said hydraulic percussion means for circulating hydraulic fluid to operate said percussion means to drive the core barrel out of the end of said drill string sub into the material to be sampled; and mud seal means for closing off the annular space between the interior of said sub and the exterior of said sampler.

6. The core sampler of claim 5 further characterized in that said mud seal means is a dynamic mud seal slidable inside the drill string.

7. A wire line core sampler for use in a drill string sub, said sub and said sampler defining an annular space therebetween comprising a core barrel insertable into said sub and freely movable therein and extendable out of the end thereof; a core barrel adaptor closing off the upper end of said core barrel, said core barrel adaptor including an anvil block extending above said core barrel; hydraulic percussion means insertable into said sub and freely movable therein operably connected to said core barrel adaptor, said hydraulic percussion means including a hammer for striking said anvil block; mud turbine means insertable into said sub and freely movable therein connected to said hydraulic percussion means for circulating hydraulic fluid to operate said percussion means; and mud seal means for closing off the annular space between the interior of said sub and the exterior of said sampler.

8. The core sampler of claim 7 further characterized in that said mud seal means is a dynamic mud seal slidable inside the drill string.

9. A wire line core sampler for use in a drill string comprising a tubular cylindrical sub connectable to the lower end of a drill string; a core barrel insertable into said sub and freely movable therein and extendable out of the end thereof; a core barrel adaptor closing off the upper end of said core barrel, said core barrel adaptor including an anvil block extending above said core barrel; hydraulic percussion means insertable into said sub and freely movable therein operably connected to said core barrel adaptor, said hydraulic percussion means including a hammer for striking said anvil block; mud turbine means insertable into said sub and freely movable therein connected to said hydraulic percussion means for circulating hydraulic fluid to operate said percussion means; and mud seal means for closing off the annular space between the interior of said sub and the exterior of said sampler.

10. A wire line core sampler for use in a drill string sub said sub and said sampler defining an annular space therebetween comprising a drilling sub connectable to the lower end of a drill string, a core barrel insertable through said drill string into said sub and freely movable therein and extendable out the end thereof; a core barrel adaptor closing off the upper end of said core barrel, said core barrel adaptor including an anvil block extending above said core barrel; hydraulic percussion means insertable into said sub and freely movable therein operably connected to said core barrel adaptor, said hydraulic percussion means including a closed circuit hydraulic system for operating a hammer for striking said anvil block; mud turbine means insertable into said sub and freely movable therein connected to said hydraulic percussion means for circulating hydraulic fluid in said closed circuit hydraulic system to operate said percussion means; and mud seal means for closing off the annular space between the interior of said sub and the exterior of said sampler.

11. A wire line core sampler for use in a drill string comprising a tubular cylindrical sub connectable to the lower end of a drill string; a core barrel insertable into said sub and freely movable therein and extendable out of the end thereof; a core barrel adaptor closing off the upper end of said core barrel, said core barrel adaptor including an anvil block extending above said core barrel; hydraulic percussion means insertable into said sub and freely movable therein operably connected to said core barrel adaptor, said hydraulic percussion means including a closed circuit hydraulic system for operating a hammer for striking said anvil block; mud turbine means insertable into said sub and freely movable therein connected to said hydraulic percussion means for circulating hydraulic fluid in said closed circuit hydraulic system to operate said percussion means; and mud seal means for closing off the annular space between the interior of said sub and the exterior of said sampler.

* * * * *